US007054230B1

(12) United States Patent
Nelson

(10) Patent No.: US 7,054,230 B1
(45) Date of Patent: May 30, 2006

(54) LOCATOR DEVICE FOR SUBMERGED STRUCTURES

(75) Inventor: Robert S Nelson, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 249 days.

(21) Appl. No.: 10/823,072

(22) Filed: Apr. 13, 2004

(51) Int. Cl.
*B63B 45/08* (2006.01)

(52) U.S. Cl. ..... 367/131; 441/11

(58) Field of Classification Search ..... 367/131, 367/135; 441/7, 11
See application file for complete search history.

(56) References Cited

U.S. PATENT DOCUMENTS 1,605,343 A * 11/1926 Gould et al. ..... 441/11
3,613,616 A * 10/1971 Basset ..... 441/11
3,618,150 A * 11/1971 Anselmi ..... 441/20
3,981,036 A * 9/1976 Higgs ..... 441/7
4,040,135 A 8/1977 Arnold
4,784,626 A 11/1988 DeLaro
5,066,256 A 11/1991 Ward, Sr.
5,163,858 A * 11/1992 Sumrall ..... 441/11
6,195,039 B1 * 2/2001 Glass, Jr. ..... 342/357.09
6,202,588 B1 * 3/2001 Hebrard ..... 441/6
6,850,152 B1 * 2/2005 Woodall et al. ..... 441/11

* cited by examiner

*Primary Examiner*—Ian J. Lobo
(74) *Attorney, Agent, or Firm*—Allan Y. Lee; MIchael A. Kagan; Peter A. Lipovsky

(57) ABSTRACT

Locator device that can be used to aid in the recovery of or to provide positional information about a structure that becomes submerged. The locator device for submerged structures consists of one or more modules. Each module can be customized to incorporate one or more features including a power source, a transmitter or source, a receiver or detector, a fastener means, a computer, buoyancy means, a propulsion means, and a communications means.

4 Claims, 4 Drawing Sheets

LOCATOR DEVICE FOR SUBMERGED STRUCTURES

BACKGROUND OF THE INVENTION

The invention relates generally to detection and recovery of sunken objects and more particularly, to a locator device that aids in the location and recovery of structures that become submerged.

Structures, such as towed acoustic arrays, surface vessels, submarines, remotely controlled and autonomous vehicles, planes, helicopters, platforms, pipes, cables, and nets that become submerged need to be located and/or retrieved within an acceptable time frame and cost. Although retrieval of the submerged structure or its contents may not be feasible, positional information of the submerged structure may still be useful in order to determine its integrity or cause of failure. For example, a segment of an underwater cable breaks loose and needs to be reconnected; or a plane crashes into the ocean and the owners want to determine the cause of the accident. The value of these structures can be substantial and location and retrieval costs can be significant if a lengthy search effort is required or if the search effort must be delayed due to weather, time of day, political sensitivities, lack of search or recovery equipment, etc. In addition, the underwater environment can be complex due to a number of factors such as extreme depths and pressure levels, temperature, a non-uniform water column, bottom properties, the presence of man-made objects, the presence of marine plants and animals, and limited visibility.

Conventional recovery methods that employ acoustical or optical (ultraviolet, visible, infrared) detection systems to search a large region may offer a low probability of success. Thus, there is a need for a locator device that facilitates the location of a submerged structure and enables its timely recovery. A locator device that can be attached to the structure at risk without significantly altering its operational parameters or requiring major modifications is desirable.

BRIEF DESCRIPTION OF THE DRAWINGS

For a more complete understanding of the locator device for submerged structures, reference is now made to the following detailed description of the embodiments as illustrated in the accompanying drawings, wherein.

(a)

(b)

(c)

(d)

Throughout the several views, like elements are referenced using like references.

DESCRIPTION OF THE EMBODIMENTS

It is instructive to describe a scenario in which locator device 10 can be employed. Consider the problem of retrieving all or part of a towed acoustic transducer array that has separated from the towing vessel and is adrift. The towed array is formed by connecting a number of cylindrically-shaped transducer elements that are temporarily configured to be neutrally buoyant at a specified operational depth. Unfortunately, a separated array segment will eventually sink if the towing vessel does not snag it quickly. If the separated array segment sinks, it may be desirable to recover or salvage it at a later time. Delayed recovery operations, covert or overt, are typically expensive and time consuming. Locator device 10 can reduce the recovery operation time or eliminate the need for a recovery operation at a later date.

Shown in FIGS. 1–4 is locator device 10 that can be used to aid in the recovery of or to provide positional information about a structure that becomes submerged. Locator device 10 for submerged structures consists of one or more modules. Each module can be customized to incorporate one or more features including a power source, a transmitter or source, a receiver or detector, a fastener means, a computer, buoyancy means, a propulsion means, and a communications means. Each module may contain redundant features.

Figure 1:
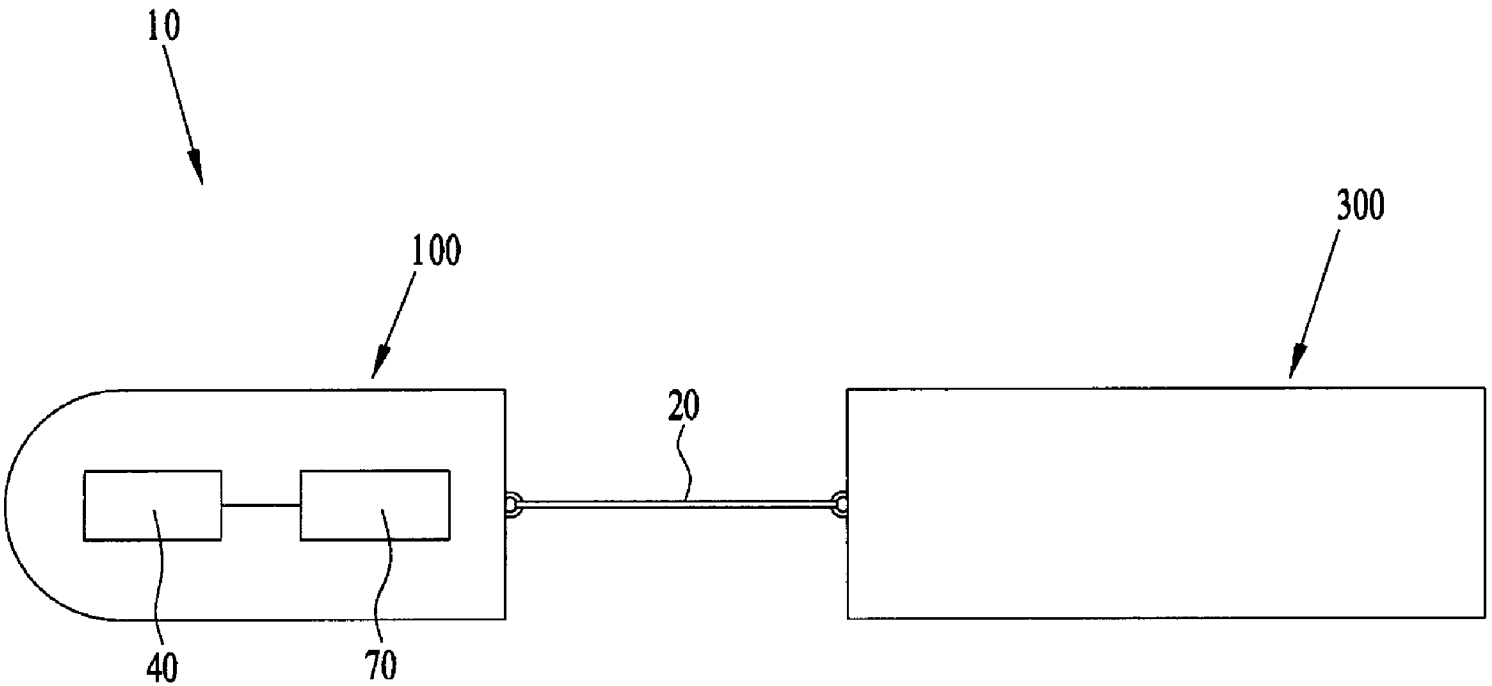
FIG. 1 is a schematic representation of the locator device comprising a single module.

FIG. 1 is a schematic representation of one embodiment of locator device. In this embodiment, locator device 10 comprises a single first module 100. Tether 20 connects first module 100 to structure 300 and pays out to allow first module 100 to reach the water surface if structure 300 accidentally becomes submerged. First module 100 comprises source 40 such as, for example, an acoustic pinger or an optical flasher. Source 40 may be activated by a computer command from computer 70 or by a set of events such as when a connection is broken or a threshold pressure level is measured. When activated, source 40 marks the location of first module 100. The embodiment shown in FIG. 1 may be adequate in applications where the submerged structure can be located and/or retrieved within a short period of time.

Locator device 10 has two general modes of operation: automatic retrieval mode and semi-automatic retrieval mode. In the automatic retrieval mode, locator device 10 evaluates the situation and initiates a sequence of recovery steps. In the semi-automatic mode, locator device 10 is activated by instructions from the submerged structure or from a remote search and/or recovery unit. Manual intervention can also be used to activate locator device 10. Once activated, locator device 10 operates in automatic retrieval mode or continues to communicate with the submerged structure or the remote search and/or recovery unit.

Figure 2:
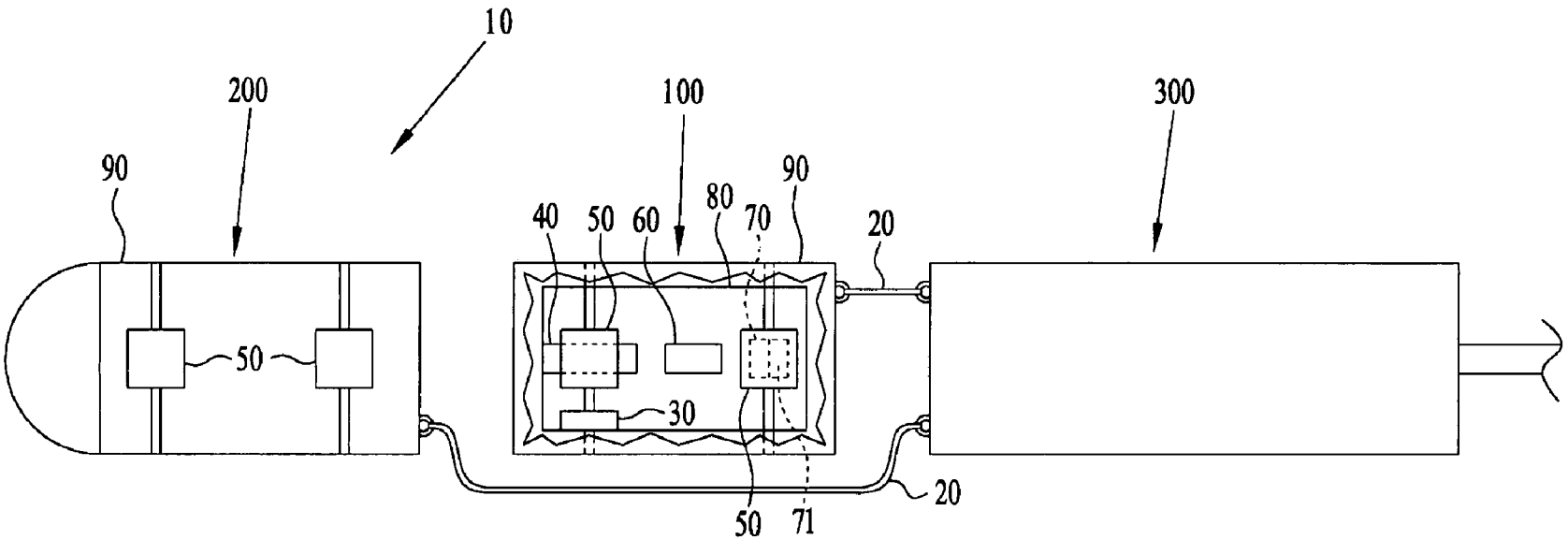
FIG. 2 is a schematic representation of the locator device comprising two modules, which is attached to a structure, a towed acoustic array.

FIG. 2 is a schematic representation of another embodiment of locator device 10 attached to a structure such as, for example, a towed acoustic array. In this embodiment, locator device 10 comprises two modules, first 100 and second 200 modules, which are attached to array segment 300 of the towed acoustic array. The acoustic array is provided by way of example only, and it is therefore to be understood that the structure to which locator device 10 may be attached includes other structures such as surface vessels, submarines, remotely controlled and autonomous vehicles, planes, helicopters, platforms, pipes, cables, and nets that, if they become submerged, need to be located and/or retrieved within an acceptable time frame. Preferably, the shape and size of locator device 10 has minimal impact on the operation of the structure to which locator device 10 is attached. For example, a clandestine application may require a locator device with a larger feature set than a commercial application. A locator device with cylindrically-shaped modules may be suitable for a surface vessel or a submarine, but modules with a flat shape may be preferred if the locator device is mounted on the wing of an airplane. On the other hand, a locator device comprising modules with a flat and curved shape may be preferred if the locator device is mounted on the body of an airplane. As shown in FIG. 2, first 100 and second 200 modules have diameters similar to array segment 300 and are sized such that attaching locator device 10 has little effect on the operational use of the acoustic array.

First module 100 comprises acoustic transducer 30, which transmits and receives acoustic signals, for communications with second module 200, and/or array segment 300, and/or a search and/or recovery unit (not shown). Computer 70, having data storage 71, performs functions to include but not limited to: control the operation of acoustic transducer 30, monitor the environment, transmit data, send instructions, and receive remote instructions. When activated, acoustic pinger 40 marks the location of first module 100. Acoustic pinger 40 may be activated as the result of a command from computer 70 or by a set of events such as, for example, a connection is broken or a maximum or minimum pressure level is measured. Acoustic pinger 40 can be programmed to operate in a number of modes: continuous, periodic (at specific times and with specific repetition rates), covert, etc. depending on the application. First module 100 also comprises power supply 60 such as a battery or batteries. Many types of batteries can be employed based on requirements such as cost, power density, voltage and current, storage lifetime, and whether there is a need to recharge. Two such battery types in common use are metal-hydride and lithium-based (lithium, lithium-ion, lithium-polymer) batteries. Other types of power supplies, such as for example, combustion engines, are available. Power supply 60 provides power to acoustic transducer 30, acoustic pinger 40, computer 70, and any other motors, computers, sources, and receivers incorporated into first module 100.

Inner housing 80 and optional outer casing 90 can be made of inherently buoyant materials such as, for example, polyurethane and reinforced polyurethane. First 100 and second 200 modules can also be structured with compartments such that the modules are buoyant. Preferably, the net buoyancy of second module 200, including the length of tether 20 it must drag to the water surface, is positive such that second module 200 will ascend to the surface without a propulsion source. A propulsion source can be used to overcome negative buoyancy and to permit second module 200 to maneuver as it ascends.

If necessary, first 100 and second 200 modules are made neutrally buoyant by attaching removable weights 50 to one or both modules. If the modules are sufficiently small such that towed array operation is acceptable even if the modules are buoyant, then removable weights 50 need not be used. As shown in FIG. 2, both modules have removable weights 50, which may be installed internally or externally to the modules. Removable weights 50 can be implemented in a number of ways. For example, removable weight 50 can be a reversible weight, which is a device that includes a chamber that can be purged of, or filled with, water by a motor-driven piston, a pump, an inflatable bladder, or by gravity. Another example is a unit that is physically attached to the modules and then released by a disengaging mechanism that breaks the physical coupling. Disengaging removable weight 50 can be achieved by means to include but not limited to: unscrewing a bolt, a thread, or interlock; lifting a latch; releasing a magnetic interlock; cutting a cable or line; setting off an explosive charge; releasing a corrosive chemical; or using heat. Yet another example involves breaking a seal such that a weight made from a water-consumable material is exposed to water. Removable weights 50 are released in response to or in the absence of a stimulus. For example, the weights could be released if physical or electrical contact is broken. Release of the weights can be under computer control or can be with designed failure of mechanisms, such as seals or capsules that have maximum pressure ratings.

Mechanical links 20, such as tethers, connect the first 100 and second 200 modules to each other and to array segment 300. Tether 20 should preferably offer low drag resistance, which can be advantageous if long lengths are required. Tether 20 may be sufficiently strong such that array segment 300 can be retrieved directly using only the tether. Tether 20 is preferably made from a strong, light, thin material, such as Kevlar® although alternative designs may include features such as fiber optic or conductive wire for communications or power transmission. The life of the material should be sufficient to ensure that it is robust for the specified maximum submersion time prior to recovery. Tether 20 can be mounted on a free-wheeling reel or a motor-controlled reel. Instead of mechanical links 20, an alternative is the use of acoustic or optical links, which may increase the operational range of locator device 10.

First 100 and second 200 modules must be sufficiently robust such that the structural integrity of at least part of the modules is not compromised if the pressure increases beyond a maximum value. For example, the pressure level may correspond to the crush depth of the acoustic array. It may be desirable to design the modules such that specific components will fail if the pressure becomes too great. For example, the seal of a consumable removable weight would be broken and expose the water-reactive material to water. First 100 and second 200 modules can be constructed as a single unit or assembled from sub-units. Sub-units can have compartments or be cast as solid pieces.

Figure 3:
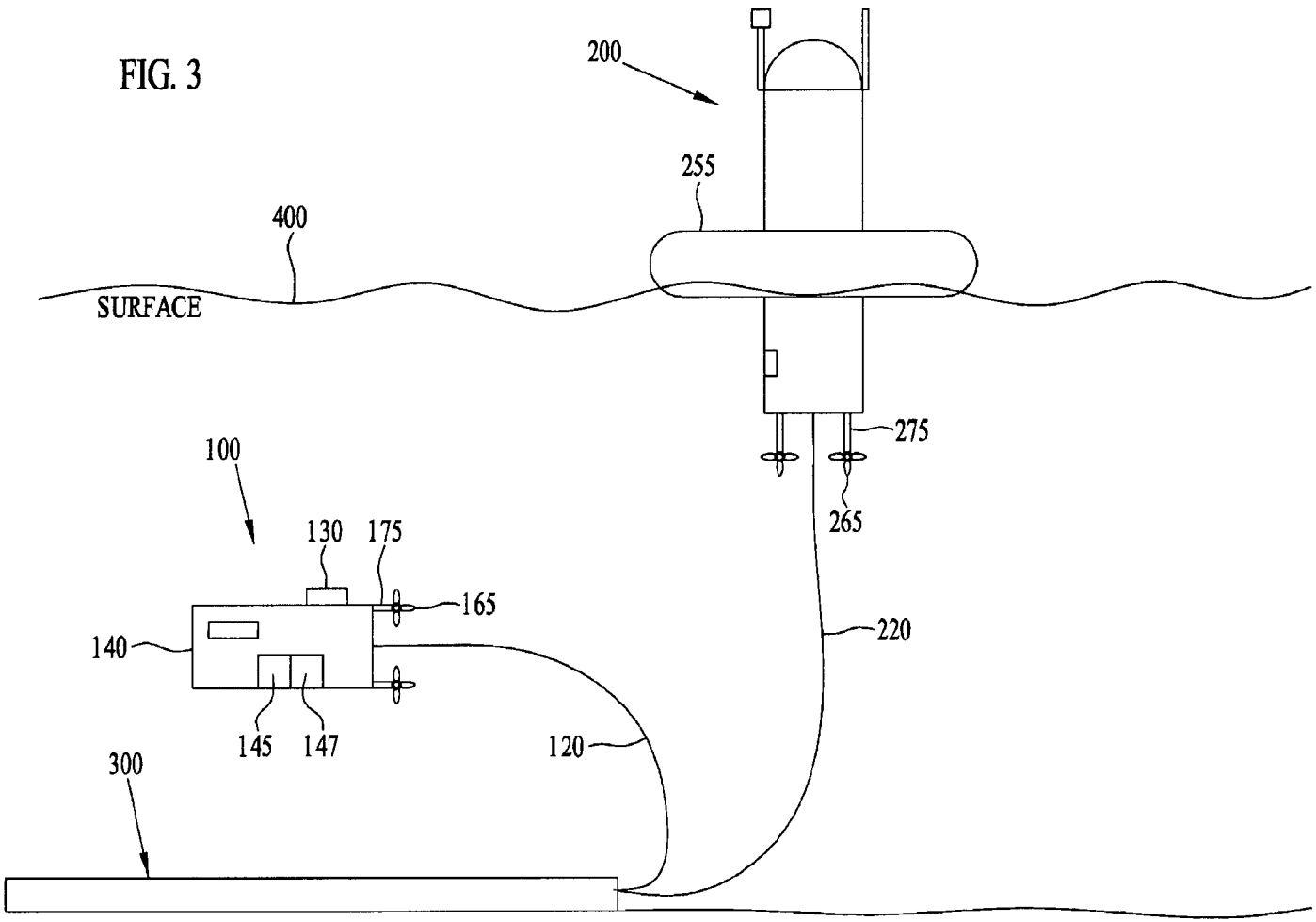
FIG. 3 is a schematic representation of the locator device, where a first module is shown submerged with a structure while a second module is shown floating at the water surface.

Referring now to FIG. 3, first module 100 is shown submerged with array segment 300 while second module 200 is shown floating at water surface 400. If removable weights 50 (shown in FIG. 1) were used with first module 100, they are released when array segment 300 separates and begins to submerge. In this embodiment, first module 100 includes optical camera 145 and illuminator 147 to allow limited inspection of the submerged array segment 300. Images are acquired, analyzed, and stored for transmission to second module 200 or a search and/or recovery unit. With the addition of a propulsion system such as, for example, motorized propeller 165 and steering fins 175, first module 100 can move about array segment 300 and a more detailed inspection can be conducted. A motor-driven reel (not shown) can be used with tether 120 so that the height of first module 100 above the array segment 300 can be controlled. First module 100 includes source 140, such as an acoustic pinger, to transmit the location of first module 100. Instead of an acoustic pinger, an optical source can also be used. Ionizing radiation sources, such as neutron emitters, can be used in instances where secrecy is a priority or a long-term beacon is required. First module 100 also comprises transducer 130 for communications.

Still referring to FIG. 3, second module 200 can float freely or under motor control to water surface 400. The ascent and mobility of second module 200 can be aided by the propulsion system, motorized propeller 265 and steering fins 275. If array segment 300 breaks, the propulsion system allows second module 200 to track array segment 300 as it drifts or to remain in the vicinity if it submerges. In situations where second module 200 should not breach the water surface at all or should only do so for limited periods of time, such as covert operations or in hazardous sea states, tether 220 can be motor-driven to control the location of second module 200.

Figure 4:
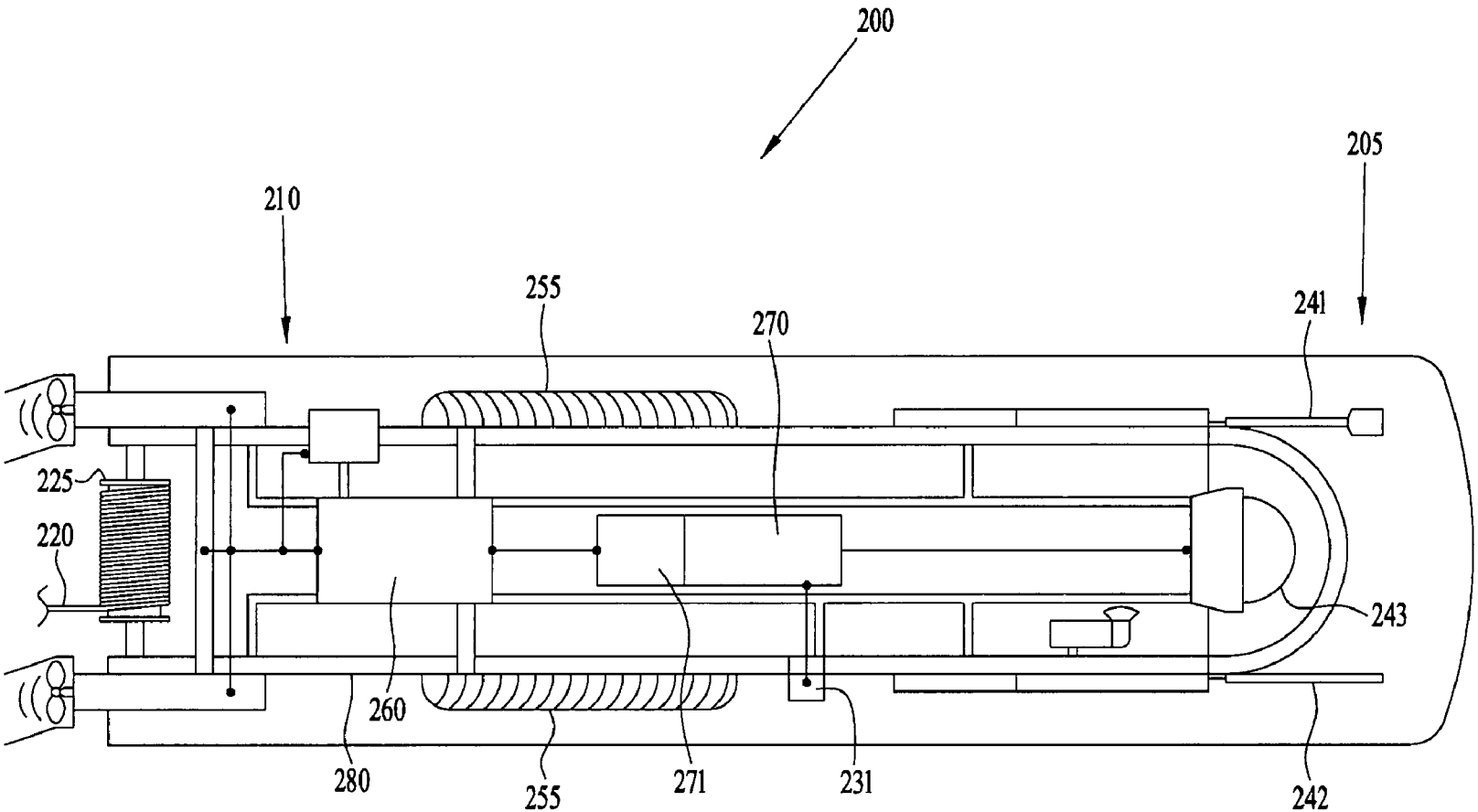
FIG. 4 is a schematic representation of a module of the locator device.

FIG. 4 is a schematic representation of another embodiment of second module 200. In this embodiment, second module 200 comprises computer 270, having data storage 271, for signal processing and decision-making services. Subsystems within second module 200 can have their own computers. Second module 200 further comprises pressure and temperature sensor 231, which can be used to determine when to release removable weights, if used, or when to deploy floatation device 255. Floatation device 255 can expand automatically or upon command during ascent or after breaking the water surface. Floatation device 255 can be a bag connected to a compressed air source or filled with compressed foam. Floatation device 255 can be housed internally or attached externally. Typical materials will be waterproof and puncture-resistant. Floatation device 255 can be reflective and brightly colored in order to aid visual location of module 200. Floatation device 255 provides an additional buoyant force, may increase the stability of the surfaced module, and can also be used to control the orientation of second module 200. By altering the weight distribution, the tilt angle of second module 200 can be adjusted. This feature can be useful for tracking the sun, locating a satellite, or directional broadcasting and receiving.

In this embodiment, second module 200 comprises first 241 and second 242 extension arms and dome 243. Sources and receivers which include optical, radio, acoustic, and ionizing radiation devices such as, for example, flashers, acoustic sources, antennas, GPS processors, solar collectors, illuminators, and imagers such as optical and acoustic cameras, can be embedded within module 200 or mounted on powered, retractable extension arms 241 and 242. For example, an illuminator and camera could be mounted on first extension arm 241 and an antenna could be mounted on second extension arm 242. By incorporating an illuminator and camera into the module, second module 200 can inspect submerged array segment 300 prior to ascending to the surface. Images can be processed, analyzed, and stored for transmittal to or direct acquisition by a search and/or recovery unit. Dome 243 can be of transparent material such that solar optical radiation can be focused onto a solar cell or a pulsed optical source can provide the functionality of a flasher or a beacon. Inflatable bag 255 is preferably mounted externally to inner housing 280. Computer processor 270 provides signal processing and decision-making services and controls the operations of devices such as sources, receivers, sensors, motors, and disengaging mechanisms included in second module 200. One or more power supplies 260 are used to provide power required by the various devices in second module 200. Tether 220 is mounted on reel 225, which can be free-wheeling or motor-controlled.

As shown in FIG. 4, second module 200 comprises top end 205 and base 210. To ensure that top end 205 emerges from the water when second module 200 reaches the water surface, top end 205 is lighter in weight than base 210. The desired asymmetric weight distribution can be achieved by simply assembling second module 200 such that heavier elements, such as power source 260, are located at base 210. Asymmetric weight distribution can also be reached by using removable weights to maintain a net imbalance or by building compartments within second module 200 and flooding select compartments.

Clearly, many modifications and variations of the locator device for submerged structures are possible in light of the above teachings. It is therefore to be understood that within the scope of the appended claims the locator device for submerged structures may be practiced otherwise than as specifically described.

I claim:

1. A locator device, comprising:

at least one module comprising at least one chamber, wherein said at least one module is constructed of inherently buoyant materials;

fastener means for connecting said at least one module to a structure;

at least one computer contained in said at least one chamber;

a source for transmitting a communication signal when said structure becomes submerged in a body of water, operably coupled to said at least one computer;

at least one power source operably coupled to said at least one computer and said means for transmitting a signal;

a propulsion system operably coupled to said at least one module.

2. The locator device of claim 1 wherein said propulsion system comprises a propeller and steering fins.

3. A locator device, comprising:

at least one module comprising at least one chamber, wherein said at least one module is constructed of inherently buoyant materials;

fastener means for connecting said at least one module to a structure;

at least one computer contained in said at least one chamber;

a source for transmitting a communication signal when said structure becomes submerged in a body of water, operably coupled to said at least one computer;

at least one power source operably coupled to said at least one computer and said means for transmitting a signal;

an imager for creating video data signals, wherein said video data signals are coupled to said at least one computer.

4. A locator device for submerged structures comprising:

a first module, said first module being constructed of inherently buoyant materials;

a second module, said second module being constructed of inherently buoyant materials;

a first tether connecting said first module to a structure;

a second tether connecting said second module to said structure, wherein said second tether pays out and allows said second module to ascend to the surface when said structure becomes submerged in a body of water;

a first computer contained in a chamber within said first module;

a source for transmitting a communication signal when said structure becomes submerged in a body of water, operably coupled to said first computer;

a first power source operably coupled to said first computer and said source;

a first transducer for communicating between said first and second modules, operably coupled to said first computer and said first power source;

a second computer contained in a chamber within said second module operably coupled to a second power source;

a second transducer for communicating between said first and second modules, operably coupled to said second computer and second power source.

* * * * *